US011206873B2

(12) United States Patent
Park

(10) Patent No.: US 11,206,873 B2
(45) Date of Patent: Dec. 28, 2021

(54) FUNCTIONAL UNDERWEAR SUPPORT

(71) Applicant: VERTEXKOREA LTD., Incheon (KR)

(72) Inventor: Ki Su Park, Incheon (KR)

(73) Assignee: VERTEXKOREA LTD., Incheon (KR)

( * ) Notice: Subject to any disclaimer, the term of this patent is extended or adjusted under 35 U.S.C. 154(b) by 263 days.

(21) Appl. No.: 16/354,341

(22) Filed: Mar. 15, 2019

(65) Prior Publication Data

US 2020/0196681 A1 Jun. 25, 2020

(30) Foreign Application Priority Data

Dec. 20, 2018 (KR) ..... 10-2018-0166086

(51) Int. Cl.
*A41B 9/02* (2006.01)

(52) U.S. Cl.
CPC ..... *A41B 9/023* (2013.01); *A41B 2400/20* (2013.01)

(58) Field of Classification Search
CPC .. A41B 9/023; A41B 9/12; A41B 9/14; A41B 2400/20; A41B 2400/22; A41B 17/00; A41D 13/0025
See application file for complete search history.

(56) References Cited

U.S. PATENT DOCUMENTS 321,072 A * 6/1885 Winchester ..... A61F 5/40 602/73
1,477,187 A * 12/1923 Rayne ..... A61F 5/40 602/71
2,657,396 A * 11/1953 Klein ..... A41D 13/0025 4/536
3,459,181 A * 8/1969 Mann ..... A41B 9/02 602/67
3,505,990 A * 4/1970 Hawkins ..... A41D 13/0025 600/20
4,557,320 A * 12/1985 Allen ..... B60H 1/00271 126/204
4,622,962 A * 11/1986 Kauffman ..... A61F 5/40 602/70
5,094,234 A * 3/1992 Searcy ..... A61F 5/40 602/68

(Continued)

FOREIGN PATENT DOCUMENTS

KR 10-2013-0092528 A 8/2013

*Primary Examiner* — Shaun R Hurley
*Assistant Examiner* — Bao-Thieu L Nguyen
(74) *Attorney, Agent, or Firm* — Harness, Dickey & Pierce, P.L.C.

(57) ABSTRACT

Provided is a functional underwear support for men having active exercises such as running, marathon, and cycling in which the penis and the scrotum are separately accommodated independently of each other with high air permeability, the functional underwear support including a scrotum pocket which is formed with a functional fabric such as a mesh, a coolon, or a coolmax having a high air permeability, to entirely supporting the scrotum, a penis support cover which is formed by sewing a stretchable, soft spandex fabric fixedly supporting the penis so as not to be shaken to the both left and right ends of the scrotum pocket outer side, and a rechargeable motor fan unit which is provided to one side of the scrotum pocket to remove moisture or facilitate ventilation of the scrotum and the groin.

17 Claims, 14 Drawing Sheets

(56) References Cited

U.S. PATENT DOCUMENTS 5,237,706 A * 8/1993 Nalbandian ..... A41B 9/023 2/403
5,970,519 A * 10/1999 Weber ..... A41D 13/0025 2/102
6,238,185 B1 * 5/2001 Horng ..... F04D 29/384 416/182
8,398,574 B1 * 3/2013 Wiens ..... A61F 13/061 602/68
9,393,151 B2 * 7/2016 Gallen ..... A61F 7/02
2002/0017102 A1 * 2/2002 Bell ..... B60H 1/00478 62/3.7
2006/0174392 A1 * 8/2006 Farnworth ..... A62B 17/005 2/102
2008/0027383 A1 * 1/2008 Nahhas ..... A61F 7/10 604/113
2008/0289081 A1 * 11/2008 Grey ..... A42B 1/041 2/204
2009/0288240 A1 * 11/2009 Lim ..... A41B 9/023 2/403
2011/0005236 A1 * 1/2011 Chang ..... A41D 13/0025 62/3.5
2012/0031582 A1 * 2/2012 Sullivan ..... F04D 25/084 165/47
2013/0269090 A1 * 10/2013 Liu ..... A62B 17/00 2/456
2015/0216315 A1 * 8/2015 Luckemeyer ..... A61G 7/057 5/423
2015/0282543 A1 * 10/2015 Rippert ..... A41D 13/0025 2/456
2016/0286971 A1 * 10/2016 Pan ..... A41B 9/001
2016/0327290 A1 * 11/2016 Clemente ..... A45F 3/00
2018/0070659 A1 * 3/2018 Xu ..... A41D 13/0053
2018/0146721 A1 * 5/2018 Aherne, III ..... A41D 13/0025
2018/0220721 A1 * 8/2018 Houde ..... A41D 13/0053
2018/0317572 A1 * 11/2018 Guttman ..... A41D 13/005
2019/0008219 A1 * 1/2019 Davidovits ..... A41D 13/0025
2019/0200689 A1 * 7/2019 Clemente ..... A41D 13/0025

* cited by examiner

FUNCTIONAL UNDERWEAR SUPPORT

CROSS-REFERENCE TO RELATED APPLICATION

This application claims benefit of and priority to Korean Patent Application No. 10-2018-0166086, filed on 20 Dec. 2018. The entire disclosure of the applications identified in this paragraph are incorporated herein by reference.

FIELD

The present disclosure relates to a functional underwear support for men having active exercises such as running, marathon, and cycling in which the penis and the scrotum are separately accommodated independently of each other with high air permeability, the functional underwear support including a scrotum pocket which is formed with a functional fabric such as a mesh, a COOLON®, or a COOLMAX® having a high air permeability, to entirely supporting the scrotum, a penis support cover which is formed by sewing a stretchable, soft spandex fabric fixedly supporting the penis so as not to be shaken to the both left and right ends of the scrotum pocket outer side, and a rechargeable motor fan unit which is provided to one side of the scrotum pocket 200 to remove moisture or facilitate ventilation of the scrotum and the groin.

BACKGROUND

In general, a men's underwear is a brief underwear or a boxer underwear which come into close contact with the body.

The testes which are male reproductive organs are healthy and active at a temperature of 1 to 3° C. lower than the body temperature of 36.5° C. The scrotum is located between the penis and the groin of the body to sweat in order to adjust the temperature. Therefore, during the exercise or in summer, the scrotum is maintained to be in a wet state.

The men's brief underwear can support and fix the penis and the scrotum. However, due to the elasticity of the underwear, the penis and the scrotum are in tightly contact with each other, and the sweat increases because of poor ventilation. Therefore, there is a problem that the temperature of the scrotum is raised to lower sperm activity, and a skin disease such as a heat rash or an eczema occurs.

In addition, while the men's boxer underwear is comfortable to wear, the penis and the scrotum cannot be supported and fixed, and thus, the penis and the scrotum are shaken during the exercise, which may cause discomfort to the exerciser In consideration of such problems, functional underwear for separately accommodating the penis and the scrotum has been contrived.

In the related art, in order to solve such a problem, a men's functional underwear in which the penis and the scrotum are separately accommodated are disclosed in Korean Patent Laid-Open No. 10-2013-0080379 (2013 Jul. 9). In the functional underwear, a band is formed at the upper end, and leg-through openings are formed at the lower portions of both sides, a penis pocket at the upper center and a scrotum pocket in the lower portion are separately stitched to the underwear body.

However, such conventional man's functional underwear has a problem that the penis goes towards the scrotum during active exercise, or the penis should be put into the penis pocket after urinating.

In addition, since the penis pocket and the scrotum pocket are separately are stitched to the underwear body, the manufacturing process is complicated, and thus, the productivity is lowered.

SUMMARY

The present disclosure is to provide a functional underwear support including a scrotum pocket which is formed with a functional fabric such as a mesh, a COOLON®, or a COOLMAX® having a high air permeability, to entirely supporting the scrotum, a penis support cover which is formed by sewing a stretchable, soft spandex fabric fixedly supporting the penis so as not to be shaken to the both left and right ends of the scrotum pocket outer side, and a rechargeable motor fan unit which is provided to one side of the scrotum pocket 200 to remove moisture or facilitate ventilation of the scrotum and the groin.

In order to achieve the above object, the functional underwear support according to the present invention includes a scrotum pocket which is formed with a functional fabric such as a mesh, a COOLON®, or a COOLMAX® having a high air permeability, to entirely supporting the scrotum, a penis support cover which is formed by sewing a stretchable, soft spandex fabric fixedly supporting the penis so as not to be shaken to the both left and right ends of the scrotum pocket outer side, and a rechargeable motor fan unit which is provided to one side of the scrotum pocket 200 to remove moisture or facilitate ventilation of the scrotum and the groin.

The scrotum pocket is formed with a functional fabric such as a mesh, a COOLON®, or a COOLMAX® having a high air permeability, and the edge portion of the scrotum pocket being in contact with a skin of the scrotum and the groin is sewn with a binding tape of a soft material.

The penis support cover is formed by sewing a stretchable, soft spandex fabric fixedly supporting the penis when sewing the edge portion of the scrotum pocket with a binding tape to the both left and right ends of the scrotum pocket outer side and is opened vertically. Alternatively, one end of the penis support cover fabric is sewn to one side edge of the left and right sides of the scrotum pocket outer side, and the other end of the penis support cover fabric is provided with a velcro tape, a snap button, a button, or the like to be fixed to the other side of the scrotum pocket.

The rechargeable motor fan unit is configured with a battery, a DC motor, a blowing fan, a charging terminal, an external air absorption hole, a blowing hole, and the like and a rechargeable motor fan unit is attached to the scrotum pocket outer side in order to remove moisture and facilitate ventilation of the scrotum, the groin, and the like.

As described above, the functional underwear support according to the present invention has high air permeability when worn, and the scrotum and the penis are separately accommodated independently of each other, and thus, the scrotum and the penis of such men having active exercises such as running, marathon, and cycling are fixedly supported by the scrotum pocket and the penis support cover, so that the scrotum and the penis are prevented from coming into contact with each other or coming into contact with the thighs and are not shaken to be helpful in having pleasant exercises.

In addition, the rechargeable motor fan unit provided to the scrotum pocket outer side of the functional underwear support according to the present invention is configured with a battery, a DC motor, a fan, a charging terminal, an external air absorption hole, and a blowing hole, and the like. Due to the rechargeable motor fan unit, the ventilation of the scrotum pocket of such a man who drives a car, works on a chair, or does outdoor exercise for a long time is facilitated, so that it is possible to obtain the effect of preventing a skin disease such a heat rash or an eczema in the scrotum and the groin.

DETAILED DESCRIPTION

Figure 1:
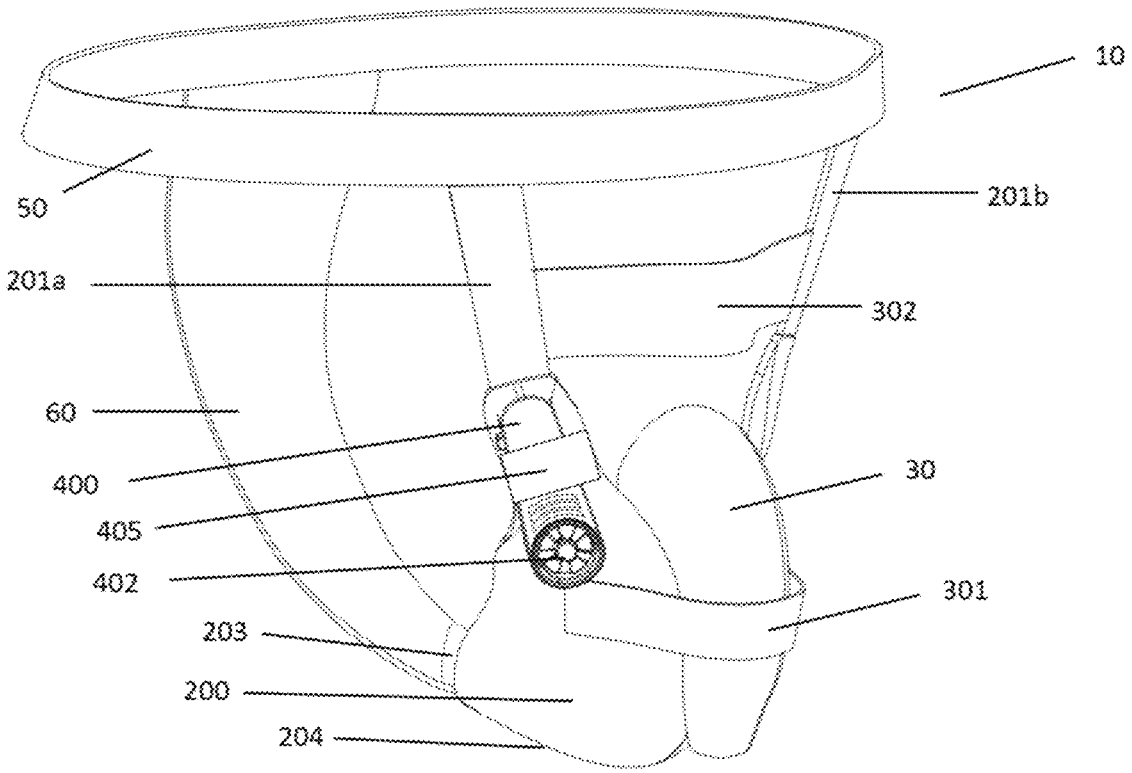
FIG. 1 is a perspective view illustrating a functional underwear support according to an embodiment of the present invention.

Hereinafter, embodiments of the present invention will be described in detail with reference to the accompanying drawings.

The terms used in the description of the present invention are defined in consideration of functions in the present invention and thus may be changed according to users, customs, and the like, but the definition of the term should be based on the entire contents of this specification.

In addition, the size, the line thickness, and the like of the constituent elements illustrated in the drawings referred to in describing the present invention may be exaggerated somewhat for the convenience of understanding.

FIG. 1 is a perspective view illustrating a functional underwear support according to an embodiment of the present invention.

The functional underwear support according to the embodiment of the present invention includes a scrotum pocket 200 which is formed with a functional fabric such as a mesh, a COOLON®, or a COOLMAX® having a high air permeability to entirely supporting the scrotum, a penis support cover 301 which is formed by sewing a stretchable, soft spandex fabric fixedly supporting the penis so as not to be shaken to the both left and right ends of the scrotum pocket outer side and is opened vertically, and a rechargeable motor fan unit 400 which is provided to one side of the scrotum pocket 200 to remove moisture or facilitate ventilation of the scrotum and the groin.

The scrotum pocket 200 is provided with stretchable scrotum pocket connection bands 201*a* and 201*b* connected vertically to the front surface portion of the waist band 50 surrounding the waist in the circumferential direction at both upper left and right side ends having a U shape of the front surface portion of the scrotum pocket with the penis 30 as the center. The scrotum pocket 200 is formed with a functional fabric such as a mesh, a COOLON®, or a COOLMAX® having a high air permeability, and the edge portions of the scrotum pocket 200 being in contact with a skin of the scrotum and the groin is sewn with a binding tape of a soft material.

The penis support cover 301 is formed by sewing a stretchable, soft spandex fabric fixedly supporting the penis when sewing the edge portion of the scrotum pocket with a binding tape to the both left and right ends of the scrotum pocket outer side 204 and is opened vertically. Alternatively, one end of the penis support cover 301 is sewn to one side edge of the left and right sides of the scrotum pocket outer side 204, and the other end of the penis support cover 301 is provided with a velcro tape, a snap button, a button, or the like to be fixed to the other side of the scrotum pocket.

Figure 2:
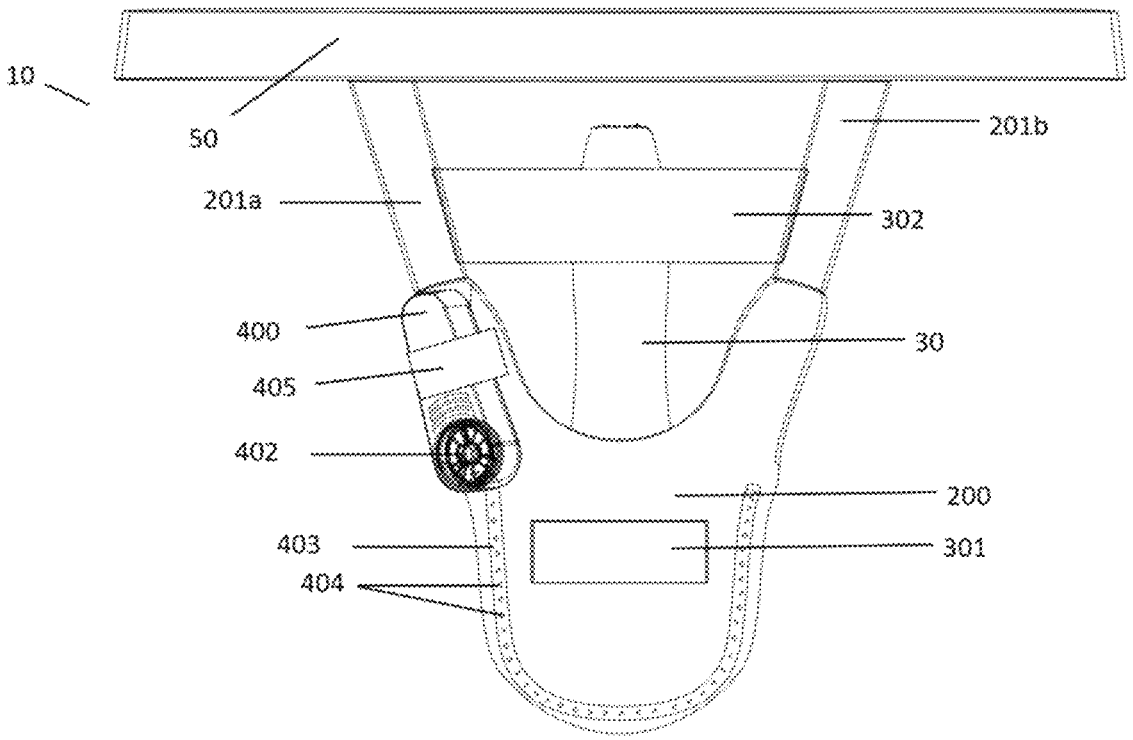
FIG. 2 is a front view illustrating a rechargeable motor fan unit and a ventilation tube of the functional underwear support according to the embodiment of the present invention.

FIG. 2 is a front view illustrating a rechargeable motor fan unit 400 and a ventilation tube 403 of the functional underwear support 10 according to the embodiment of the present invention.

A penis support cover 302 is provided to the scrotum pocket connection bands 201*a* and 201*b* for connecting the waist band 50 and the scrotum pocket 200 vertically at the front surface portion of the functional underwear support 10 according to the embodiment of the present invention. The penis support cover 302 is configured with a band or fabric material which is stretchable in order to support the penis when the penis is erected.

In addition, the lower end portion 203 of the scrotum pocket closer to the perineal region is sewn to the one end of a soft back surface fabric 60 having air permeability, and the back surface portion of the waist band 50 is sewn to the other end of the back surface fabric 60.

In addition, the lower end portion 203 of the scrotum pocket closer to the perineal region of the back surface fabric 60 has a narrow width and a wider width toward the waist band 50 of the back surface portion.

The scrotum pocket 200 is provided with a rechargeable motor fan unit 400 on the scrotum pocket outer side 204 to remove moisture and facilitate ventilation of the scrotum and the groin, and a rechargeable motor fan unit fixing band 405 or a rechargeable motor fan unit fixing pocket is installed to one side of the scrotum pocket outer side 204 in order to provide the rechargeable motor fan unit 400. The rechargeable motor fan unit 400 is configured with a battery, a DC motor, a blowing fan, a charging terminal, an air absorption hole, a blowing hole, and the like, and a rechargeable motor fan unit 400 is provided to the scrotum pocket 200 in order to remove moisture and facilitate the ventilation of the scrotum and the groin.

A ventilation tube 403 having a plurality of ventilation holes 404 which are passages for sending wind generated from a rechargeable motor blowing fan to the scrotum and the groin is detachably provided to the outside or the inside of the scrotum pocket 200. The one side of the ventilation tube 403 is detachably provided to the blowing hole on the blowing direction side of the blowing fan 402 in the rechargeable motor fan unit 400.

FIGS. 3A to 3E are a front view and a perspective view illustrating the rechargeable motor fan unit 400 and the ventilation tube 403 according to the embodiment of the present invention.

Figure 3A:
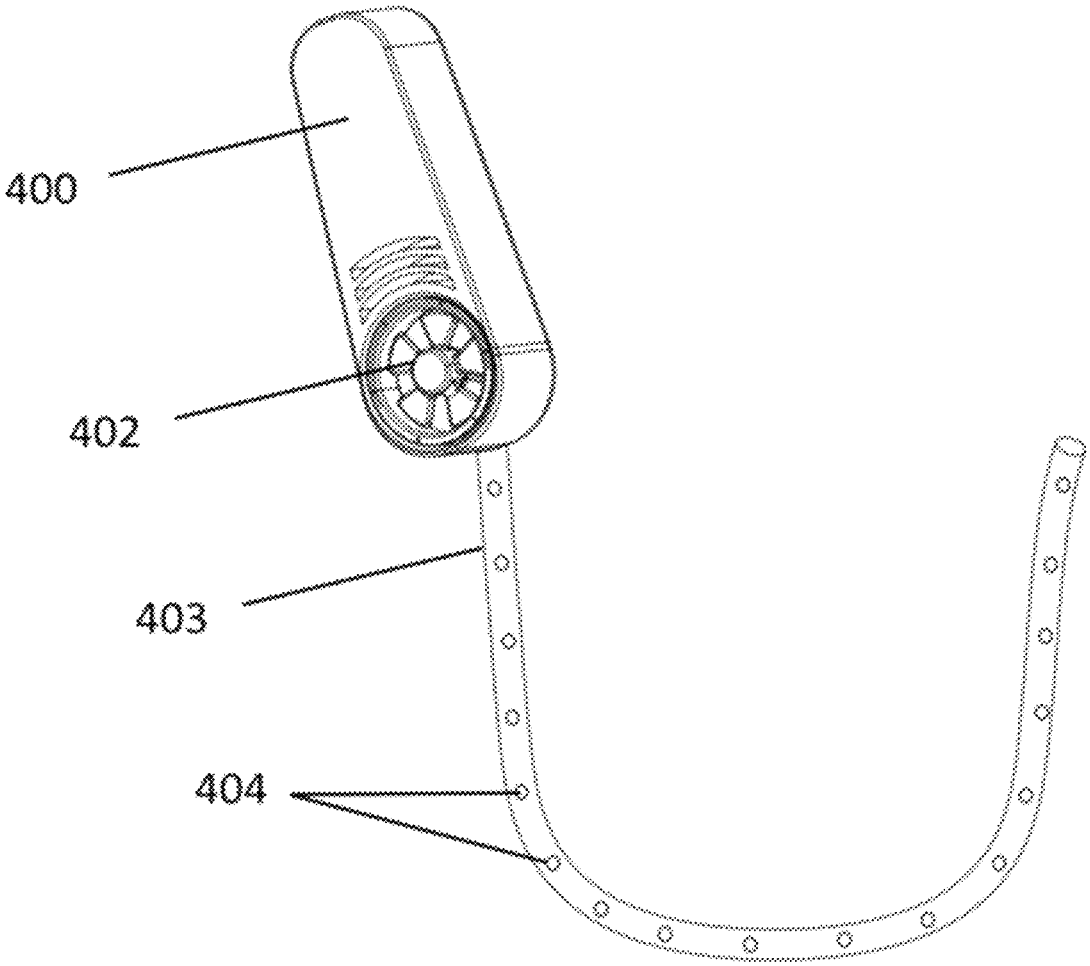
FIGS. 3A, 3B, 3C, 3D and 3E are front views and perspective views illustrating a rechargeable motor fan unit, a ventilation tube, and an external air absorption hole according to the embodiment of the present invention.
Figure 3B:
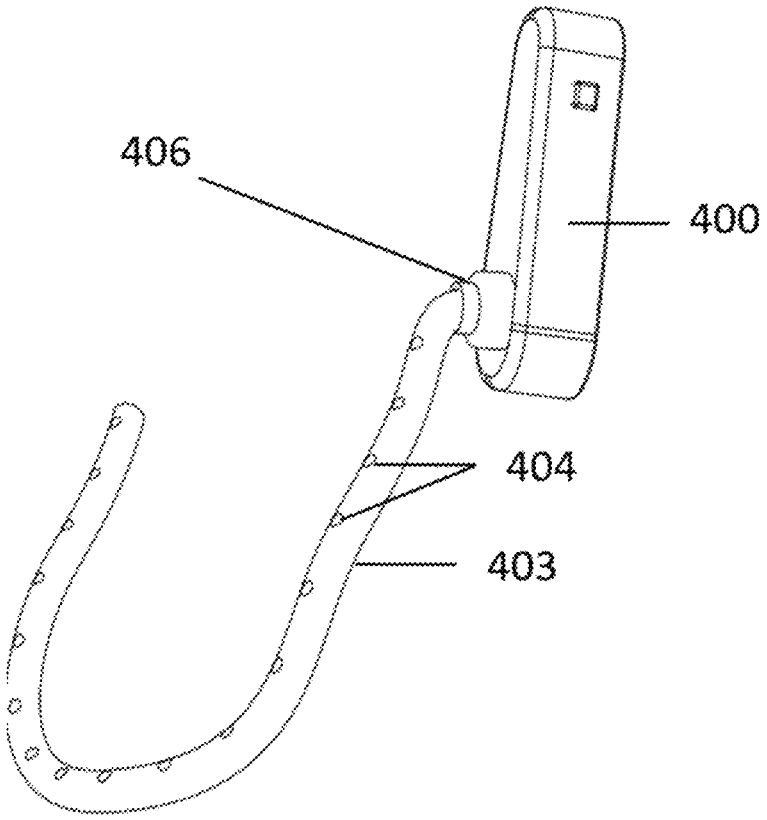

FIG. 3A is a perspective view illustrating the air absorption hole and the blowing fan 402 of the rechargeable motor fan unit in a state where the rechargeable motor fan unit 400 and the air ventilation tube 403 are coupled to each other. FIG. 3B is a perspective view illustrating a state where a blowing hole 407 on the blowing direction side of the rechargeable motor fan unit 400 and the ventilation tube 403 are coupled through the rechargeable motor fan unit and a ventilation tube connection unit 406.

Figure 3C:
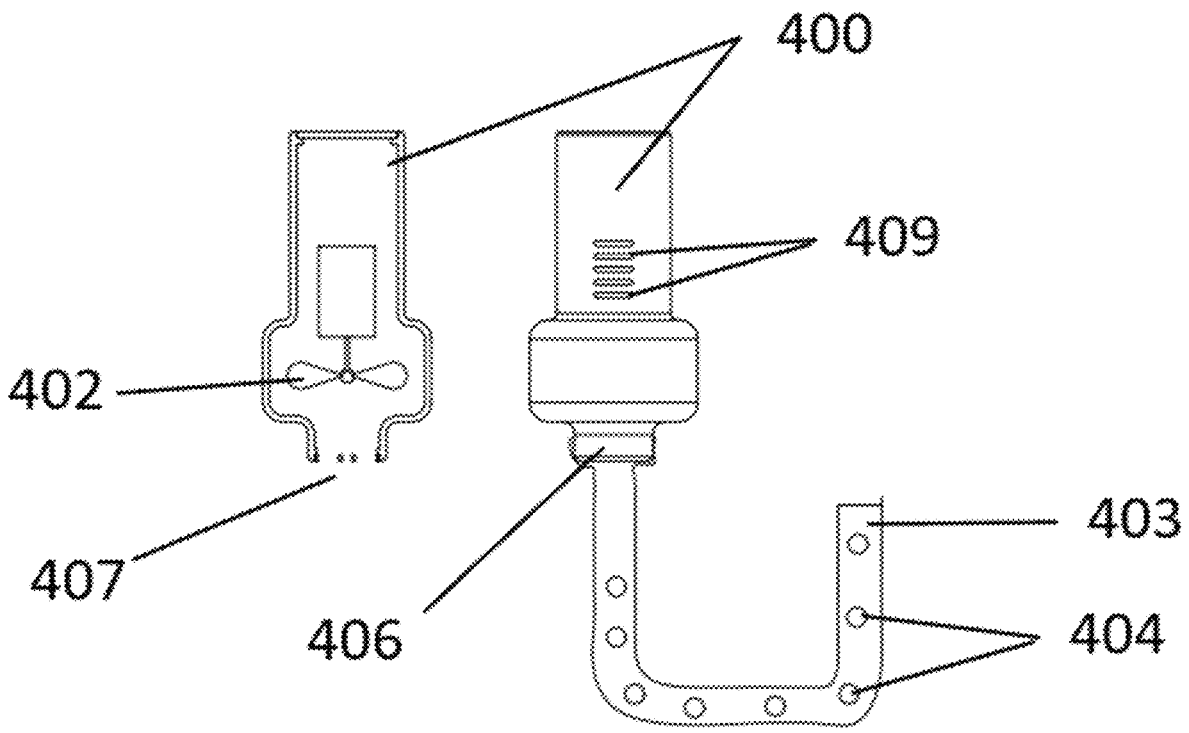

FIG. 3C is a cross-sectional view illustrating in a rechargeable motor fan unit 400 having a different design according to the embodiment of the present invention where the blowing fan 402, the blowing hole 407 on the blowing direction side, and rechargeable motor fan unit are connected in series to the ventilation tube connection unit 406 and the ventilation tube 403.

In addition, the rechargeable motor fan unit 400 and the ventilation tube 403 are detachably provided to the rechargeable motor fan unit and the ventilation tube connection unit 406.

Figure 3D:
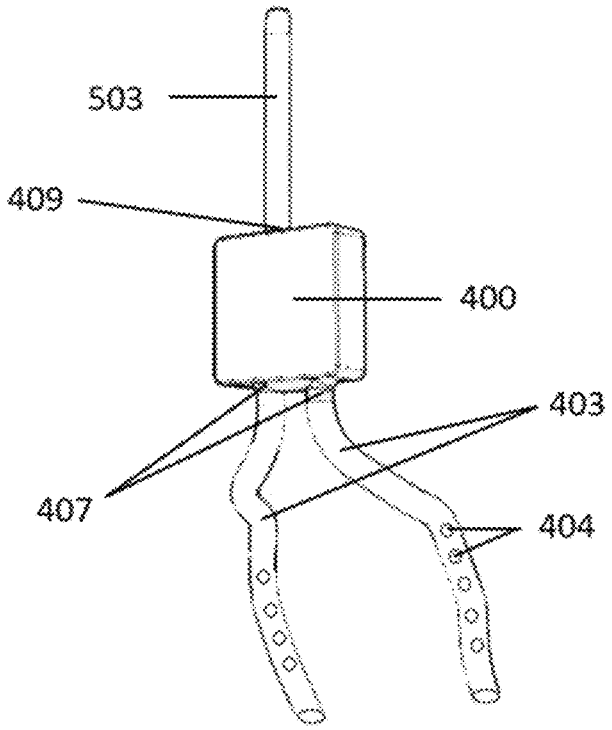

In FIG. 3D, in the rechargeable motor fan unit 400 according to the embodiment of the present invention, the external air absorption tube 503 made of a flexible, elastic material for absorbing an external air outside the trousers 500 into the rechargeable motor fan unit 400 is detachably provided to the air absorption hole 409 of the rechargeable motor fan unit 400, and the blowing hole 407 of the rechargeable motor fan unit 400 for blowing the cool external air absorbed through the external air absorption tube 503 is provided with the ventilation tube 403 having the detachable ventilation holes 404.

The rechargeable motor fan unit 400 can be attached to the waist band 50 or the trousers belt 501 by adjusting the length of the ventilation tube 403 to be long.

Figure 3E:
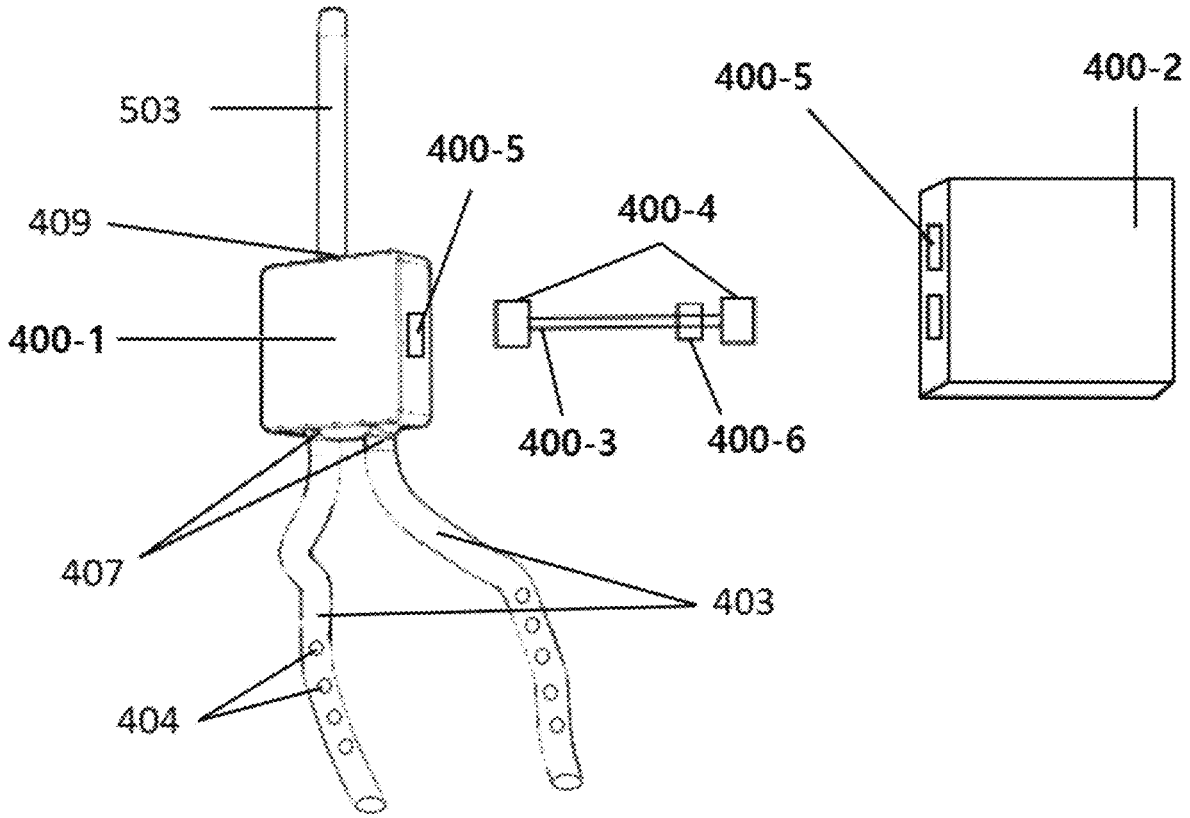

FIG. 3E illustrates a functional underwear support 10 according to an embodiment of the present invention. The functional underwear support 10 includes a motor fan unit 400-1 configured with a DC motor, a blowing fan, a power connection terminal, an air absorption hole, a blowing hole, and the like, a rechargeable battery 400-2 is configured with a charging terminal, a battery, a power connection terminal, and the like, a detachable power cable 400-3, and a power on/off switch 400-6 provided on one side of the motor fan unit 400-1 or the power cable 400-3. The power cable 400-3 includes a connector 400-4 at the end thereof to be coupled to a power connection terminal 400-5 of the motor fan unit 400-1 and the rechargeable battery 400-2, and a USB connector is provided to one side of the power cable 400-3 coupled with the rechargeable battery 400-2 or an auxiliary battery.

And a detachable DC adapter is connected to the connector 400-4 coupled to one end of the power cable 400-3 to operate the motor fan unit 400-1 through an AC power source or a cigar jack of a vehicle.

In the usage standard of the rechargeable motor fan unit 400 or the motor fan unit 400-1, the voltage is DC 3 to 12 V, the rated speed is 2, 000 to 12, 000 rpm, the air flow is 1.5 to 4.0 CFM, and the noise level is 15 to 35 dBA.

The voltage is DC 3 to 12 V, preferably DC 3.7 to 6 V, and more preferably DC 5 V. In case of less than DC 3 V, increasing the number of revolutions (RPM) has the effect of increasing the current value and increasing the power consumption of the battery. In case of more than DC 12 V, the size is increases, and the battery capacity is also increased.

The rated speed is 2, 000 to 12, 000 rpm, preferably 4, 000 to 8, 000 rpm, and more preferably 6, 000 rpm. In case of less than 2, 000 rpm, the number of revolutions of the blowing fan is lowered, and thus, the blowing efficiency of the scrotum pocket is low. In case of more than 12, 000 rpm, the wind becomes stronger than necessary, and thus, the noise is severe.

The air flow is 1.2 to 4.0 CFM, preferably 1.8 to 2.5 CFM, and more preferably 2.0 CFM. In case of less than 1.2 CFM, the blowing strength is low, and thus, the blowing efficiency for the scrotum pocket is low. In case of more than 4.0 CFM, the wind becomes stronger than necessary, and thus, the noise is severe.

The noise level is 10 to 35 dBA, and the noise level is preferred as low as possible. However, the noise level is preferably 18 to 27 dBA, more preferably 27 dBA or less in consideration of the blowing strength. In case of less than 10 dBA, the noise level is low, but the blowing strength is weak. In case of more than 35 dBA, the noise is severe, and thus, it is difficult to apply to the scrotum pocket.

The ventilation tube 403 is made of a flexible, elastic material such as silicon, a rubber, polyurethane, or a soft plastic. the ventilation tube cover 408 is sewn or joined with a functional material fabric having air permeability such as a mesh so that the ventilation tube 403 can be fixedly supported in the scrotum pocket outer side or the scrotum pocket inner side.

Figure 4A:
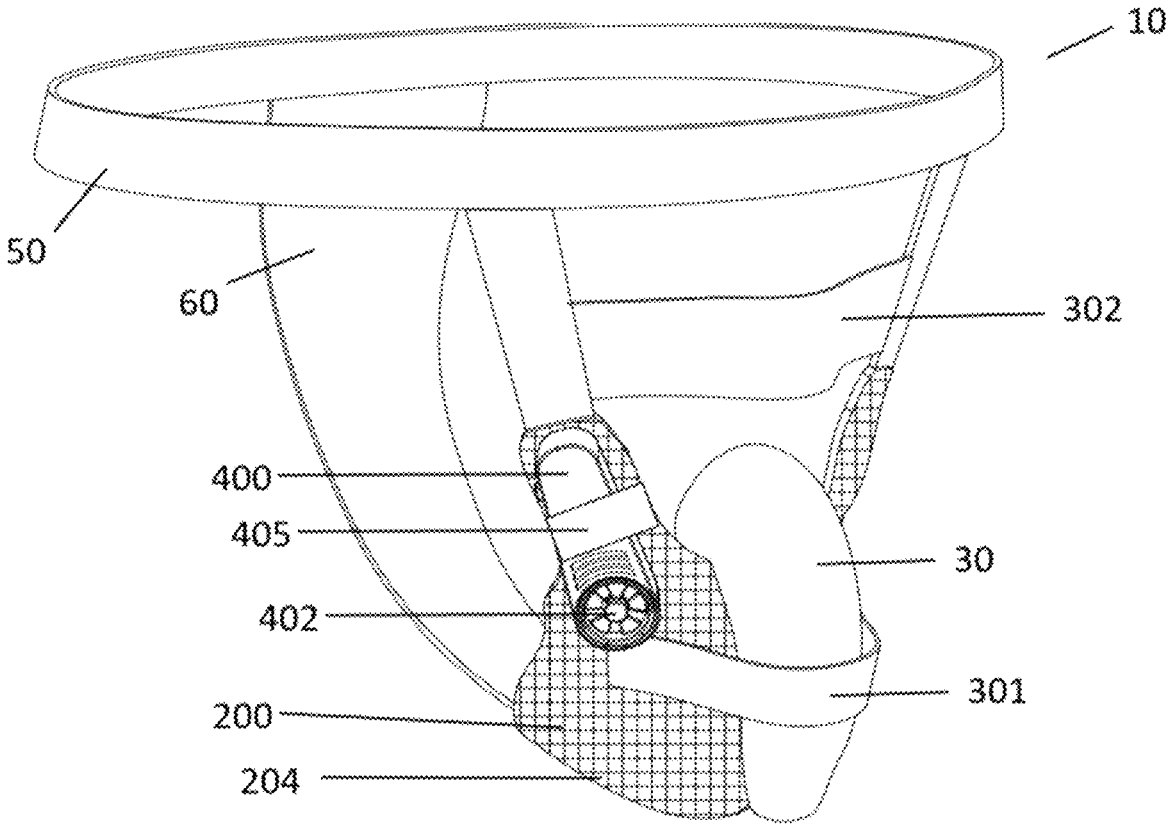
FIGS. 4A and 4B are perspective views illustrating a scrotum pocket and a rechargeable motor fan unit of the functional underwear support according to an embodiment of the present invention.
Figure 4B:
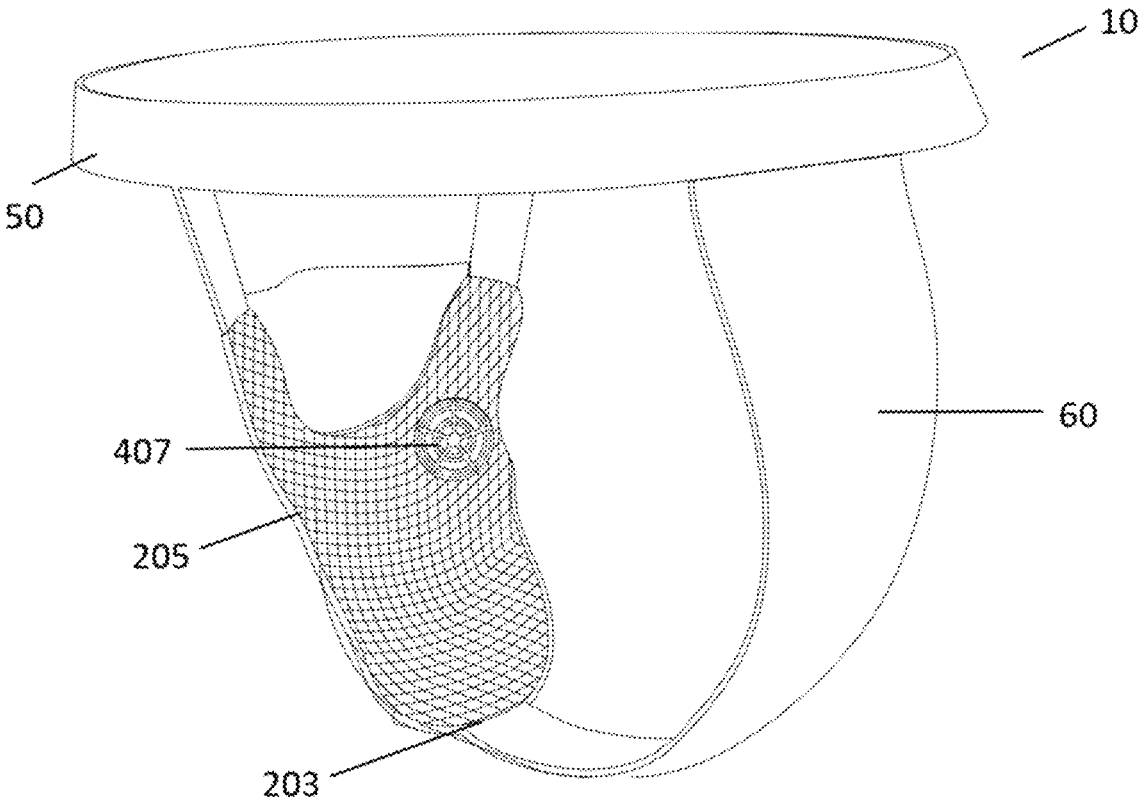

FIGS. 4A and 4B are perspective views illustrating the scrotum pocket 200 and the rechargeable motor fan unit 400 of the functional underwear support 10 according to an embodiment of the present invention.

FIG. 4A is a perspective view illustrating a state where the rechargeable motor fan unit 400 is provided to one side of the scrotum pocket 200. FIG. 4B is a perspective view illustrating the inside of FIG. 4A, where the blowing hole 407 of the rechargeable motor fan unit 400 is provided in the scrotum pocket inner side 205.

The scrotum pocket 200 is made of a functional fabric having air permeability such as an air mesh, a 3D air mesh, or a mesh so that the air entering the scrotum pocket inner side 205 through the blowing hole 407 of the rechargeable motor fan unit 400 on the blowing direction side is smoothly circulated.

In addition, in the functional underwear support 10 including a scrotum protection cup which is formed of a material such as silicon, a rubber, polyurethane, or a plastic and provided to the scrotum pocket and is worn in order to protect the penis and the scrotum during the exercise, the rechargeable motor fan unit 400 is provided to one side of the scrotum pocket, and the blowing hole 407 of the rechargeable motor fan unit 400 is provided to the inside of the scrotum protection cup. The rechargeable motor fan unit 400 or the motor fan unit 400-1 is provided to one side of the scrotum protection cup, or the ventilation tube 403 is provided to the scrotum protection cup.

Figure 5A:
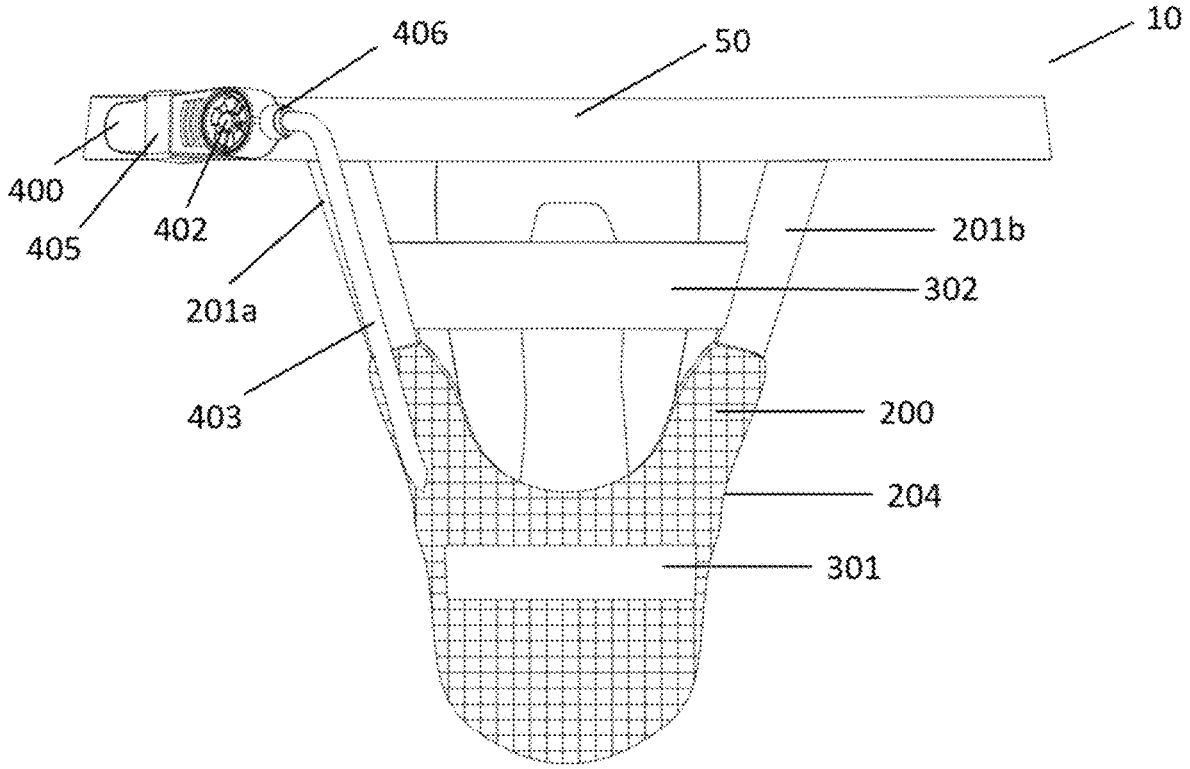
FIGS. 5A and 5B are a front view and a perspective view illustrating a rechargeable motor fan unit and a ventilation tube of the functional underwear support according to the embodiment of the present invention.
Figure 5B:
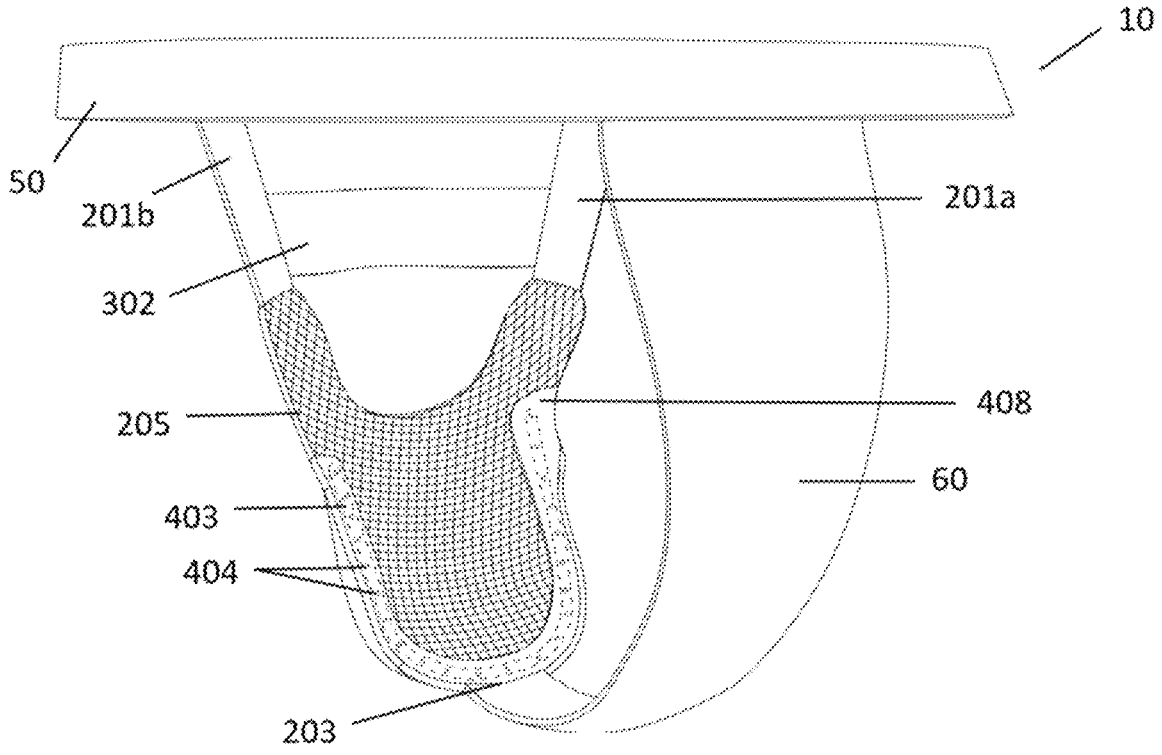

FIGS. 5A and 5B are a front view and a perspective view illustrating the rechargeable motor fan unit 400 and the ventilation tube 403 included in the functional underwear support 10 according to the embodiment of the present invention.

FIG. 5A is a front view illustrating that the rechargeable motor fan unit 400 is attached to one side of the waist band 50 by extending the length of the ventilation tube 404 along the scrotum pocket connection band. FIG. 5B is a perspective view illustrating the inside of FIG. 5A. In FIG. 5B, a ventilation tube 403 having a plurality of ventilation holes 404 connected to a blowing hole of the rechargeable motor fan unit 400 provided to the scrotum pocket outer side is provided to the scrotum pocket inner side 205, and a ventilation tube cover 408 for fixedly supporting the ventilation tube 403 is provided to the scrotum pocket outer side 204 or the scrotum pocket inner side 205 of the scrotum pocket 200.

The scrotum pocket 200 is made of a functional fabric having air permeability such as an air mesh, a 3D air mesh, or a mesh so that the air entering the scrotum pocket inner side 205 through the ventilation tube 403 is smoothly circulated.

Figure 6A:
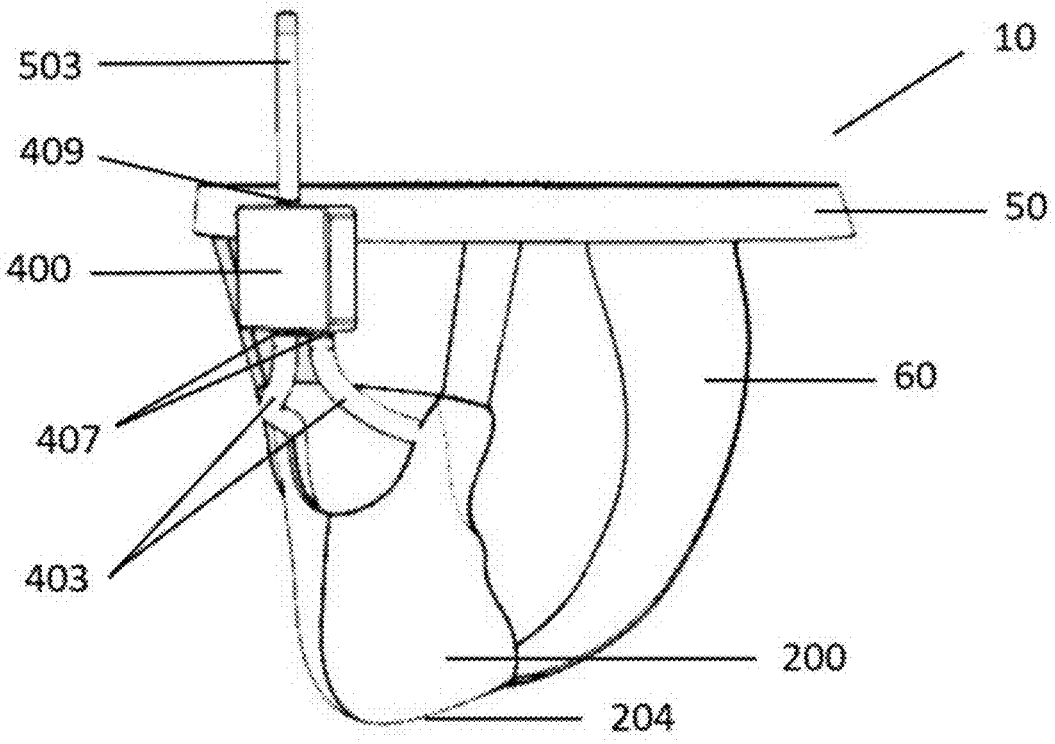
FIGS. 6A and 6B are perspective views illustrating a rechargeable motor fan unit, a ventilation tube, and an external air absorption tube of the functional underwear support according to the embodiment of the present invention.
Figure 6B:
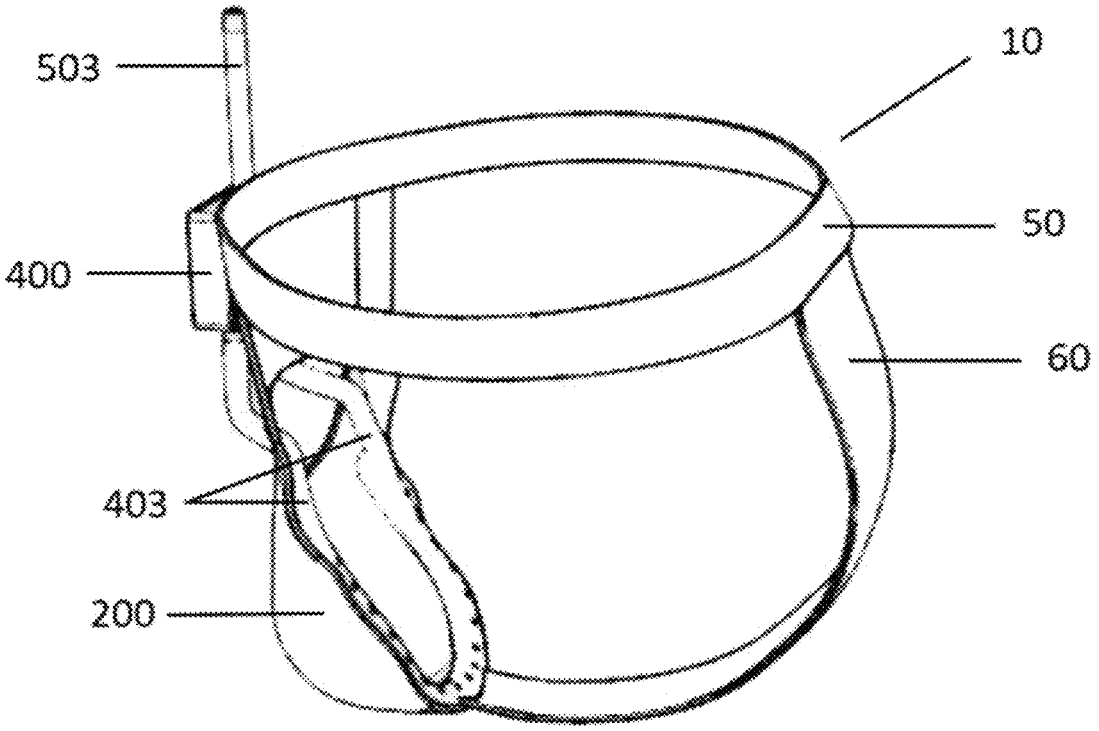

FIGS. 6A and 6B are perspective views illustrating a rechargeable motor fan unit 400, a ventilation tube 403, and an external air absorption tube 503 included in the functional underwear support 10 according to the embodiment of the present invention.

When the trousers are worn on the underwear provided with the rechargeable motor fan unit 400, the pants and the trousers come into close contact with each other, and thus, the air absorption through the air absorption hole 409 of the rechargeable motor fan unit 400 is not effectively performed. In addition, due to the body temperature higher than the temperature of the external air, a warm air enters the scrotum pocket inner side and the groin, so that the degree of satisfaction of the user may be lowered.

In FIGS. 6A and 6B, according to the embodiment of the present invention, the external air absorption tube 503 made of a flexible, elastic material for absorbing a cool external air outside the trousers 500 into the rechargeable motor fan unit 400 or the motor fan unit 400-1 is detachably provided to the air absorption hole 409 of the rechargeable motor fan unit 400 or the motor fan unit 400-1, and the blowing hole 407 of the rechargeable motor fan unit 400 or the motor fan unit 400-1 for blowing the cool external air absorbed through the external air absorption tube 503 toward the inside of the scrotum pocket is provided with the ventilation tube 403 having the detachable ventilation holes 404.

The ventilation tube 403 is provided to a groin portion of the underwear where the scrotum and the insides of the thighs come into contact with each other.

Figure 7:
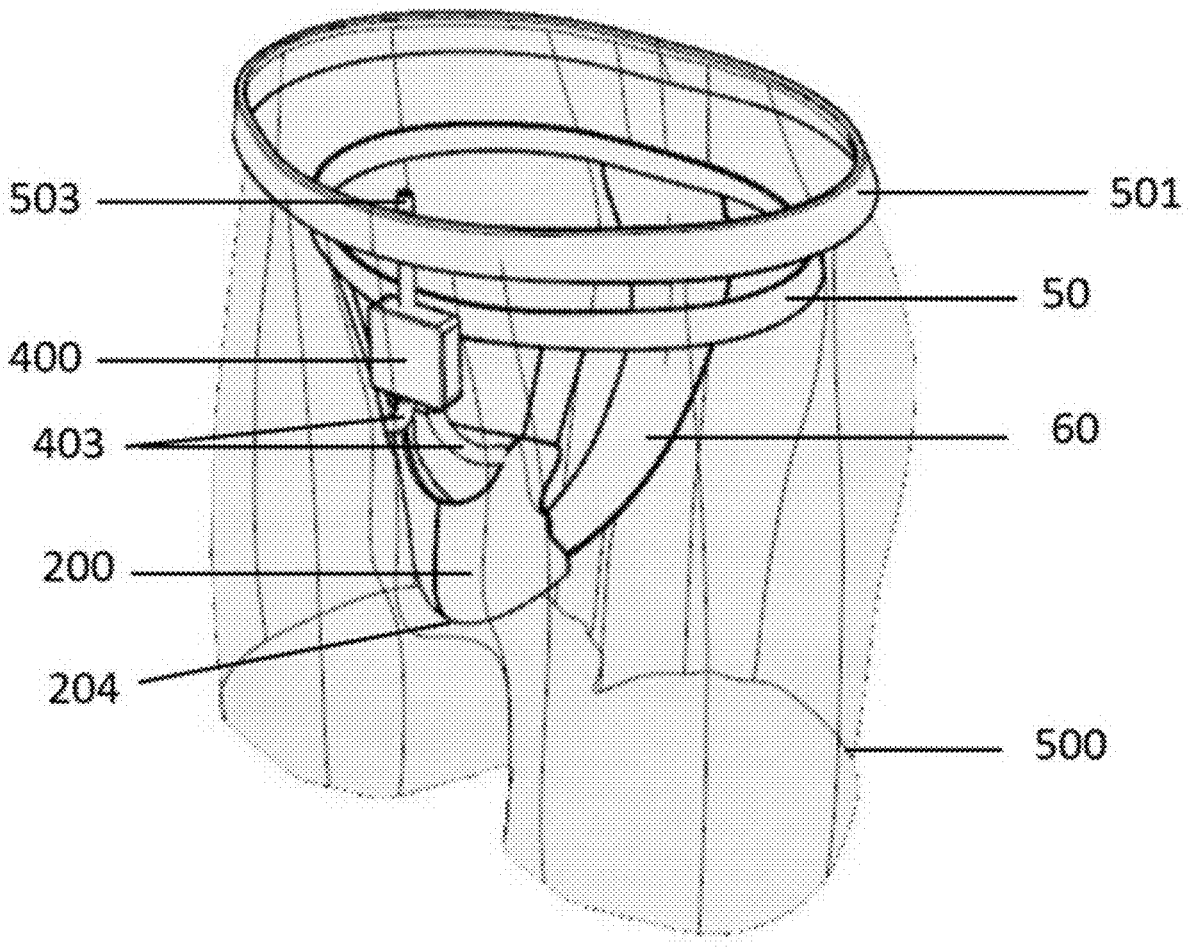
FIG. 7 is a perspective view illustrating a state where trousers are worn on the functional underwear support 10 according to the embodiment of the present invention.

FIG. 7 is a perspective view illustrating a state where the trousers 500 are worn on the functional underwear support 10 according to the embodiment of the present invention. In the state where the trousers provided with an external air absorption tube 503 and a ventilation tube 403 having a plurality of ventilation holes 404 installed in the rechargeable motor fan unit 400 or the motor fan unit 400-1 are worn.

In addition, by adjusting the length of the ventilation tube 403, the rechargeable motor fan unit 400 or the motor fan unit 400-1 is attached to one side of the trousers belt 501.

What is claimed is:

1. A functional underwear support, comprising:

a waist band;

a U-shaped scrotum pocket;

scrotum pocket connection bands connecting the waist band and the scrotum pocket vertically;

a first penis support cover connected to each of the scrotum pocket connection bands;

a second penis support cover connected to the scrotum pocket, wherein one side of the second penis support cover is fixedly attached on one side to the scrotum pocket;

a rechargeable motor fan unit provided to one side of the scrotum pocket, wherein the rechargeable motor fan unit comprises a motor fan a ventilation tube comprising a plurality of ventilation holes detachably provided to the scrotum pocket, wherein the ventilation tube is connected to the motor fan and diverges into two parts and is arranged along two edges of the U-shaped scrotum pocket.

2. The functional underwear support according to claim 1, wherein a rechargeable motor fan unit fixed pocket is provided to one side of the scrotum pocket.

3. The functional underwear support according to claim 1, wherein the rechargeable motor fan unit includes a battery, a DC motor, a blowing fan, a charging terminal, an air absorption hole, and a blowing hole.

4. The functional underwear support according to claim 1, wherein the functional underwear support includes a rechargeable battery, and a power cable.

5. The functional underwear support according to claim 1, the rechargeable motor fan unit comprises a blowing fan and a blowing hole, wherein the blowing fan, the blowing hole, and the rechargeable motor fan unit are connected in series to a ventilation connection unit and the ventilation tube.

6. The functional underwear support according to claim 1, wherein the scrotum pocket includes a ventilation tube cover.

7. The functional underwear support according to claim 1, wherein the ventilation tube having a ventilation hole is detachably provided to a blowing hole of the rechargeable motor fan unit.

8. The functional underwear support according to claim 1, wherein an external air absorption tube is detachably provided to an air absorption hole of the rechargeable motor fan unit.

9. The functional underwear support according to claim 1, wherein the rechargeable motor fan unit includes a ventilation tube connection unit.

10. The functional underwear support according to claim 1, wherein the rechargeable motor fan unit is provided to one side of a scrotum protection cup.

11. The functional underwear support according to claim 1, wherein the rechargeable motor fan unit is attached to one side of a trousers belt.

12. The functional underwear support according to claim 4, the rechargeable motor fan unit further comprises a connector for DC battery or AC power connected to one end side of the power cable, and a power on/off switch provided to one side of the power cable.

13. The functional underwear support according to claim 1, wherein, the rechargeable motor fan unit has a voltage is DC 3 to 12 V, a rated speed is 2,000 to 12,000 rpm, an air flow is 1.5 to 4.0 CFM, and a noise level is 15 to 35 dBA.

14. The functional underwear support according to claim 1, wherein the second penis support cover is detachably affixed to the scrotum pocket with hook and loop fastener tape, snap button, or button.

15. The functional underwear support according to claim 1, wherein each of the penis support covers are formed of a stretchable, spandex fabric.

16. The functional underwear support according to claim 1, wherein the scrotum pocket connection bands comprise a stretchable fabric.

17. The functional underwear support according to claim 1, wherein the scrotum pocket is formed with fabric having a high air permeability and edge portions comprising a binding tape of a soft material.

* * * * *